US006866536B1

(12) United States Patent
Lee

(10) Patent No.: US 6,866,536 B1
(45) Date of Patent: Mar. 15, 2005

(54) INSULATION DISPLACEMENT CONNECTOR

(75) Inventor: Jane X. Lee, Bloomingdale, IL (US)

(73) Assignee: Emerson Network Power, Energy Systems, North America, Inc., St. Louis, MO (US)

( * ) Notice: Subject to any disclaimer, the term of this patent is extended or adjusted under 35 U.S.C. 154(b) by 0 days.

(21) Appl. No.: 09/548,038

(22) Filed: Apr. 12, 2000

Related U.S. Application Data

(63) Continuation of application No. 09/030,564, filed on Feb. 25, 1998, now Pat. No. 6,142,817.
(60) Provisional application No. 60/040,079, filed on Mar. 7, 1997.

(51) Int. Cl.[7] ..... H01R 11/20
(52) U.S. Cl. ..... 439/395; 439/400; 439/387
(58) Field of Search ..... 439/387, 395–405, 439/821, 851–858, 417, 82, 741, 751

(56) References Cited

U.S. PATENT DOCUMENTS

| | | | | |
|---|---|---|---|---|
| 3,605,071 A | | 9/1971 | Sedlecky | |
| 3,636,500 A | | 1/1972 | Sedlecky | |
| 3,761,866 A | | 9/1973 | Sedlecky | |
| 3,957,335 A | | 5/1976 | Troy | |
| 4,059,331 A | | 11/1977 | Sedlecky et al. | |
| 4,106,837 A | | 8/1978 | Paluch | |
| 4,160,880 A | | 7/1979 | Brey | |
| 4,325,100 A | | 4/1982 | Baumbach | |
| 4,331,839 A | | 5/1982 | Baumbach | |
| 4,652,070 A | | 3/1987 | Suffi | |
| 4,846,726 A | | 7/1989 | Pala | |
| 4,919,622 A | | 4/1990 | Suffi | |
| 5,004,426 A | * | 4/1991 | Barnett | 439/82 |
| 5,127,845 A | | 7/1992 | Ayer et al. | |
| 5,139,440 A | | 8/1992 | Volk et al. | |
| 5,302,137 A | | 4/1994 | Suffi | |
| 5,324,211 A | | 6/1994 | Siemon | |
| 5,514,005 A | | 5/1996 | Jaycox et al. | |
| 5,556,296 A | | 9/1996 | Dussausse et al. | |
| 5,685,733 A | | 11/1997 | Janczak | |
| 5,759,061 A | * | 6/1998 | Jensen et al. | 439/402 |

OTHER PUBLICATIONS

"Mass Wire Insulation Displacing Termination of Flat Cable" by Donald J. Doty and George A. Patton of AMP Incorporated. (pp. 127–134), no date.
"Evaluation of Insulation Displacement Technology for use in the British Telecommunications System" by H. E. Hines, British Telecom Reseaerch Laboratories, Martlesham, Ipswich, England (pp. 163–172), no date.
"An Evaluation of the Insulation Displacement Electrical Contact" by N. K. Mitra, Berg Electronics Division, Du Pont De Nemours (Nederland) B.V. 's–Hertogenbosch, The Netherlands (pp. 99–108), no date.
"Contact Force Analysis of Slotted Beam Connectors", by Sujan Dasgupta (pp. 153–158) from the IEEE Transactions on Components, Hybrids and Manufacturing Technology—vol. CHMT–5, No. 1, Mar. 1982.

(List continued on next page.)

*Primary Examiner*—Lincoln Donovan
(74) *Attorney, Agent, or Firm*—Harness, Dickey & Pierce, P.L.C.

(57) ABSTRACT

A conductive terminal for receiving a conductor is disclosed. The terminal includes a base and two resilient beams extending from the base. Generally distal the base, the beams define a mouth for receiving the conductor. The beams have facing inner edges which define a slot extending from the mouth. The beams define a generally egg-shaped aperture in an area extending between the slot and the base.

51 Claims, 5 Drawing Sheets

OTHER PUBLICATIONS

"Cutting Force Analysis of Split Beam Connections" by Sujan Dasgupta (pp. 180–185) from the IEEE Transactions on Components, Hybrids and Manufacturing Technology—vol. CHMT–5, No. 1, Mar. 1982.

"A Unique Method to Measure the Loading Characteristics of Insulated Wire as it is Inserted into a Slot" by R. D. Malucci, AMP Incorporated, Harrisburg, PA (pp. 153–158), no date.

"Design Method for Slotted Beam Springs for Insulation Displacement Contacts" by C.G.M. van Kessel and J. H. Glashorster (pp. 408–413) from the IEEE Transactions on Components, Hybrids and Manufacturing Technology—vol. CHMT–6, No. 4, Dec. 1983.

Paper entitled "Insulation Displacement Connection Reliability" by R. A. Wandmacher published in the proceedings of the 1986 Connector and Interconnector Technology Symposium. (Appendix A of Zierick Manufacturing Torsion IDC Reliability intro.), no month.

Paper entitled "A New type of Very High Reliability Torsion IDC which can Accept a Large Range of Wire Gauges" by Janos Legrady, 1989 Symposium's proceedings of the International Institute of Connector and Interconnection Technology Inc. (Appendix B of Zierick Manufacturing Torsion IDC Reliability into), no month.

* cited by examiner

INSULATION DISPLACEMENT CONNECTOR

RELATED APPLICATIONS

This application is a CON of Ser. No. 09/030,564 filed Feb. 25, 1998 now U.S. Pat. No. 6,142,817, which claims the benefit of U.S. Provisional Application Ser. No. 60/040,079 filed Mar. 7, 1997.

BACKGROUND

Insulation Displacement Connectors (IDC) are a widely used connection technology in the communication industry. An IDC connector or clip performs two functions: severing or splitting plastic insulation surroundings a conductive wire to provide access to the conductive wire thereunder and frictionally engaging and/or compressing the conductive wire to provide electrical contact. In the design of an IDC clip, numerous variables must be considered in order to provide optimal clip design to achieve desired operating characteristics. As a general background, it is desirable to have an IDC clip which displaces the insulation, deforms the conductive wire and does not cut the conductive wire. Also, it is desirable to have an IDC clip which maintains a desired pressure on the deformed conductive wire and forms a contact area of a desired size. Further, it is desirable to provide stress distribution throughout the clip structure such that the conductive wire can be repeatedly terminated and disengaged therewith without the clip failing. Additionally, in the present communication industry, it is important to reduce the costs associated with the equipment. As such, the material cost and manufacturing costs associated with the IDC clip must be minimized.

Prior art IDC clips generally provide symmetric clip structures which function well but are not necessarily optimized. Examples of prior art IDC clips are provided in FIGS. 5–8. Typically, prior art IDC clips use a design and analysis method known as "beam" theory. The resulting arms or "beams" of the IDC clip define a generally symmetric aperture therebetween. The aperture between the beams allow for a degree of flexion or torquing of the beams relative to one another. One of the problems with the prior art design is that the symmetric aperture does not necessarily optimize the stress distribution of the beams and thus does not optimize the operating characteristics of the IDC clip. With regard to the "symmetric" structure, the reference is made to this term such that the aperture is symmetric top to bottom, left to right. For example, one prior art IDC clip design (see, FIGS. 7–9) includes an aperture which is generally an elongated opening having parallel side walls and a gap dimension between the bottom portion of the side walls and the top portion of the side walls being generally equal. While this construction functions sufficiently under a variety of circumstances it was not necessarily optimized for other applications.

OBJECTS AND SUMMARY

A general object envisioned by the present invention is to provide a conductive terminal for receiving a wire conductor where the conductive terminal provides desirable stress distribution during engagement with the wire conductor.

Another object envisioned by the present invention is to provide a conductive terminal for receiving a wire conductor where the conductive terminal can be repeatedly terminated and disengaged with the wire conductor without the conductive terminal failing.

Yet another object envisioned by the present invention is to provide a conductive terminal for receiving a wire conductor where the conductive terminal has relatively low material cost and manufacturing costs associated therewith yet is reliable and can repeatably make termination without failure.

Briefly, and in accordance with the foregoing, the present invention provides a conductive terminal for receiving a conductor. The terminal includes a base and two resilient beams extending from the base. Generally distal the base, the beams define a mouth for receiving the conductor. The beams have facing inner edges which define a slot extending from the mouth. The beams define a generally egg-shaped aperture in an area between the slot and the base.

BRIEF DESCRIPTION OF THE DRAWINGS

The organization and manner of the structure and function of the invention, together with the further objects and advantages thereof, may be understood by reference to the following description taken in connection with the accompanying drawings, wherein like reference numerals identify like elements, and in which.

DESCRIPTION

Figure 1:
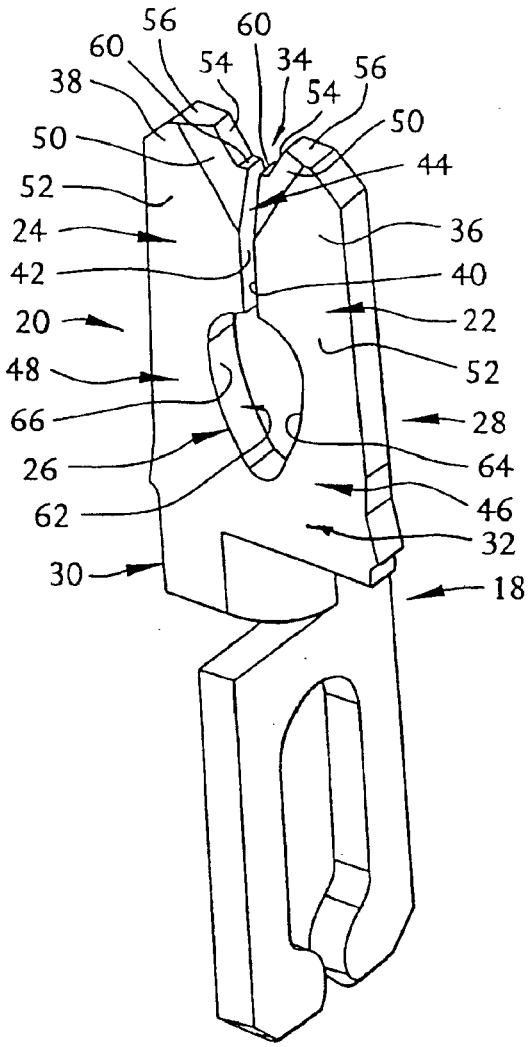
FIG. 1 is a front, right-side, top perspective view of an insulation displacement connector (IDC) in accordance with the present invention, attached to a half-tap connector.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 2:
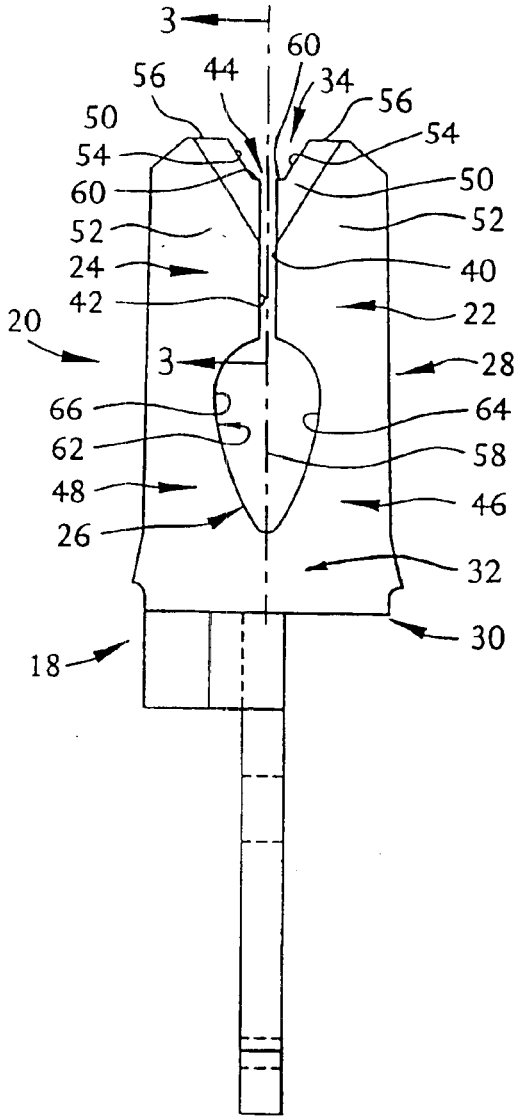
FIG. 2 is a front elevational view of the IDC of FIG. 1.
Figure 3:
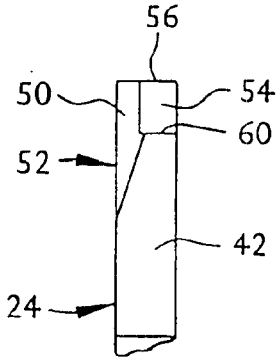
FIG. 3 is an enlarged, partial fragmentary, side-elevational view of an upper portion of a beam of the IDC of FIG. 1, taken along line 3—3 of FIG. 2.
Figure 4:
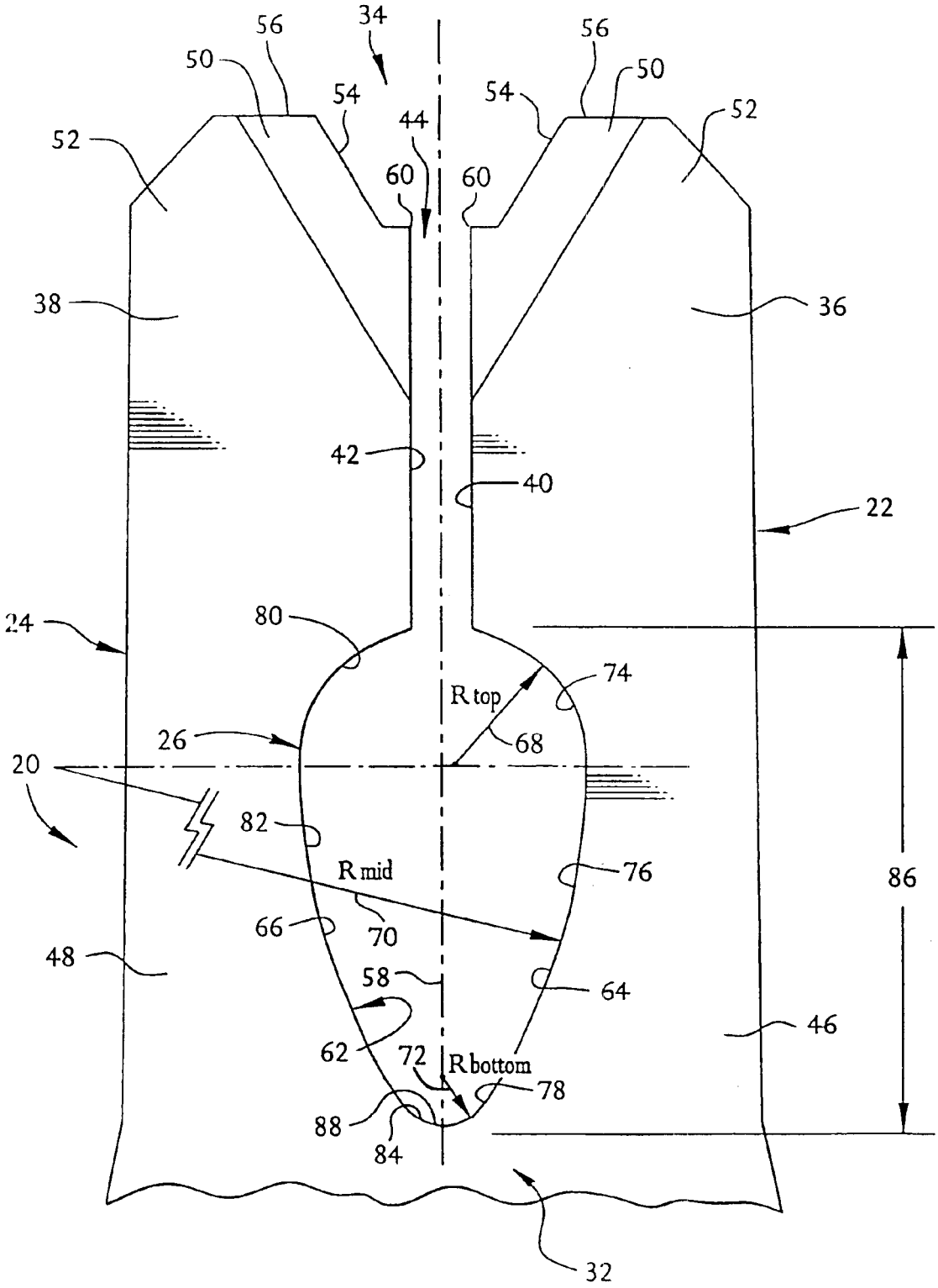
FIG. 4 is an enlarged, partial fragmentary, front-elevational view of the IDC of FIG. 1.

Shown in FIGS. 1 and 2 is a conductive terminal commonly referred to a half-tap connector 18 employing an insulation displacement connector (IDC) 20 in accordance with the present invention. FIGS. 3 and 4 show portions of the IDC 20 shown in FIGS. 1 and 2. While a conductive terminal 18 is shown as a half-tap connector, the IDC 20 may be used on a variety of other conductive terminal structures. The IDC 20 of the present invention has a novel configuration of neighboring, substantially parallel resilient beams or arms 22, 24 with a generally non-circular, egg-shaped aperture 26 defined therebetween.

Generally, when a conductor such as a conductive wire is inserted between the beams 22, 24, the IDC 20 preferably pierces or severs an outer insulating layer surrounding an inner conductor and frictionally engages or compresses the inner conductor to establish electrical contact therewith. The present invention provides a novel connector with optimized IDC 20 geometry and stress distribution under loading. The mechanical properties of the IDC 20 in accordance with the present invention facilitate reliable and repeatable termination for a predetermined range of insulated wire sizes. Also, the IDC 20 of the present invention is rather dimension insensitive such that it can be fabricated to small dimensions, if necessary, and still retain the mechanical benefits of the overall design.

With reference to FIGS. 1 and 2, the IDC 20 is formed of a body 30 including a base 32 with the two resilient beams 22, 24 extending therefrom. The beams 22, 24 are preferably two substantially parallel resilient cantilever beams. A mouth 34 is defined at the end of the beams 22, 24, generally distal the base 32 for initially receiving the conductor. An upper portion 36, 38 of the beams 22, 24 have generally facing, inner edges 40, 42 which define a gap or slot 44 therebetween, and the slot 44 extends from the mouth 34 to the aperture 26. The egg-shaped aperture 26 is defined between lower portions 46, 48 of the beams 22, 24, respectively, adjacent the slot 44. The aperture 26 is thus formed in an area extending between the slot 44 and the base 32.

When a conductor such as a conductive wire is engaged with the IDC 20, the conductor is inserted through the mouth 34 into the slot 44 between the beams 22, 24. Insertion of a wire into an IDC generally is well known in the art such that the IDC will sever an insulating jacket of the wire and engage the conductive inner portion of the wire. As shown in FIGS. 1–4, beveled surfaces 50 are provided on either side of the wire receiving mouth 34, angled inwardly from a face surface 52 of the beams 22, 24. Sides 54 of the mouth 34 are also angled inwardly from a top edge 56 of the beams 22, 24 towards a central axis 58. The angled surfaces 50, 54 help to guide the wire conductor into the slot 44. Edges 60 adjacent the generally facing, inner edges 40, 42 defining the slot 44 help cut through the outer insulating layer but preferably do not cut the inner conductor. As can be seen in FIG. 3, the angled surfaces 50, 54 and inner edges 40, 42 are generally planar surfaces which do not terminate in a pointed tip. As such, these planar surfaces tend to merely deform the inner conductor material as opposed to cutting the material.

With further reference to the enlarged, partially fragmentary, front-elevational view of the IDC 20 as shown in FIG. 4, it can be seen that the aperture 26 defined between the beams 22, 24 is non-circular and is generally referred to herein as "egg-shaped". The egg-shaped aperture 26 is formed by a generally continuous arcuate aperture edge 62 extending from the inner edges 40, 42 and extending along each beam 22, 24 and joining the beams 22, 24 at the base 32 of the IDC 20.

The aperture 26 is symmetrical about the central axis 58 which is coincident with the major axis of the egg-shaped aperture, and a line 59 perpendicular to the central axis is designated a minor axis of the egg-shaped aperture. The minor axis is drawn approximately through the widest dimension of the egg-shaped aperture but is otherwise located arbitrarily.

The term "egg-shaped" is an adjective and is defined as having an oval form, usually with one end larger than the other. See The Random House Dictionary of the English Language, $2^{nd}$ Edition, unabridged, 1987. The Dictionary also defines as egg-shaped, terms such as "ovate", "oval", "oviform" and "ovoid".

The aperture edge 62 has two generally edge halves 64, 66 which join at the base 32. Each edge half 64, 66 is defined by three different radii, shown herein by radial indicators 68, 70 and 72. In the interest of clarity in describing the invention, only the radial indicators associated with one edge half 64 of the edge 62 are shown and it is understood that the description of one half is representative of both edge halves 64, 66. The halves 64, 66 mirror each other and are symmetric about the central axis 58, and therefore so do the radii 68, 70 and 72 of each half 64 and 66 of the arcuate edge 62.

Edge half 64 is formed by three edge portions 74, 76 and 78, and half 66 is formed by three corresponding edge portions 80, 82 and 84. a first edge portion 74 of half 64 of the edge 62 is adjacent the slot 44 and is defined by a top radius 68 ($R_{top}$ in FIG. 4). The top radius 68 is sized and dimensioned to provide that the first edge portion 74 of half 64 is generally continuous and generally arcuate with the adjacent, second edge portion 76 of half 64. Likewise, the second edge portion 76 is defined by a mid-radius 70 ($R_{mid}$ in FIG. 4) which is sized and dimensioned to provide that the second edge portion 76 is generally continuous and generally arcuate with an adjacent, third edge portion 78.

As shown, edge portion 74 of half 64 is essentially a mirror image of edge portion 80 of half 66, and edge portion 76 of half 64 is essentially a mirror image of edge portion 82 of half 66. The third edge portion 78 of half 64 is defined by a bottom radius 72 ($R_{bottom}$ in FIG. 4) which is sized and dimensioned to provide that the third edge portion 78 is generally continuous and generally arcuate with edge portion 84 of half 66. Edge portion 78 of half 64 is also essentially a mirror image of edge portion 84 of half 66.

As mentioned above, edge half 64 of edge 62 is essentially a mirror image of the other edge half 66. Therefore, edge portion 80 is defined by a radius generally identical to that of radius 68 defining edge portion 74. Likewise, edge portion 82 is defined by a radius generally identical to that of radius 70 defining edge portion 76. Finally, edge portion 84 is defined by a radius generally identical to that of radius 72 defining edge portion 78.

The egg-shaped aperture 26 is defined by the top, mid and bottom radii 68, 70, 72 and an additional variable in the form of a height dimension 86 which, when combined with the radii 68, 70, 72, control the overall shape of the aperture 26. A relationship is defined by the present invention 20 such that the mid-radius 70 is greater than the top radius 68 which is greater than the bottom radius 72 or in other words, $R_{mid}(70)>R_{top}(68)>R_{bottom}(72)$. As seen in FIG. 4, the top radius 68 may extend from the minor axis 59 slightly to the right of the central axis 58 to define the first edge portion 74, while the larger mid-radius 70 may extend from the minor axis 59 far to the left of the central axis 58 to define the second edge portion 76. Finally, the small bottom radius 72 may extend from the central axis 58 below the minor axis 59 to define the third edge portion 78. Preferred ratios for these radii are as follows:

$0.05<R_{top}(68)/R_{mid}(70)<0.28$;

$1.3<R_{top}(68)/R_{bottom}(72)<4.3$; and $0.1<R_{top}(68)/\text{height}\ (86)<0.35$.

As described, the arcuate edge 62 defining the aperture 26 is composed of three pairs of different radii 68, 70, 72 symmetrically arranged along about each beam 22, 24. This provides that the aperture 26 between the beams 22, 24 is generally symmetrical along about the central longitudinal or major axis 58 of the IDC 20 but is not symmetrical about the minor axis 59. As can be seen from the figures, the first edge portions 74, 80 are positioned along the aperture edge 62 opposite one another. Similarly, the second edge portions 76, 82 are positioned opposite each other along the edge 62 and the third edge portions 78, 84 are likewise positioned opposite each other.

The IDC 20 of the present invention has been verified through finite element analysis which indicates that the aperture 26 defined by arcuate portions 74, 76, 78 and 80, 82, 84 corresponding to the radii 68, 70, 72, respectively, is capable of handling heavy bending loads. The advantage of the geometry defined by the arcuate portions 74, 76, 78 and 80, 82, 84 over prior art IDC connectors is that the present invention minimizes stress concentration at the bottom area 88 of the aperture 26 where the beams 22, 24 join at the base 32. The IDC 20 of the present invention spreads out the bending load along the arcuate portions 74, 76, 78 and 80, 82, 84 to optimize stress distribution.

The aperture 26 of the IDC 20 has been specifically described herein with reference to the specific preferred radii and arcuate edges thereof. However, one skilled in the art may recognize other non-circular and egg-shaped apertures which accomplish a similar result (i.e. efficient stress distribution) of directing the stress concentration from any one specific area of the IDC. As a result, the present invention is not meant to be limited to the specific aperture 26 and arcuate edge 62 depicted and described herein, and the edge 62, and therefore the aperture 26 defined thereby, may take other shapes.

In prior art IDC structure, when a wire is engaged with the IDC, high bending stresses concentrate at the bottom portion of the aperture where the beams join each other. These high stresses cause the prior art IDCs to yield and fail to perform proper wire termination. When the prior art IDC yields at the corners and fails to complete a proper wire termination, the stress at other locations along the beams are typically well below the yield point of the material. As such, prior art IDC connectors do not optimize the mechanical properties of the IDC structure.

In contrast, the IDC 20 of the present invention optimizes stress distribution under loading and optimizes the mechanical properties of the IDC material and structure. As a result, the IDC connector 20 of the present invention is rather dimension insensitive and can be fabricated to be much smaller (for example, 50% smaller) than a comparable prior art IDC used to terminate the same, or even a smaller, range of wire sizes, using the same material for the IDC connector. As such, the present invention minimizes the size and material costs yet improves the reliability and repeatability of the IDC to make termination without failure. Consequently, the density of the IDC connectors can be increased within a given area while still being capable of terminating a broad range of wire sizes. As such a plurality of pairs of resilient beams 22, 24 can be produced extending from a common base 32. This would allow interconnectivity of the conductor connected with respective pairs of beams.

Figure 5:
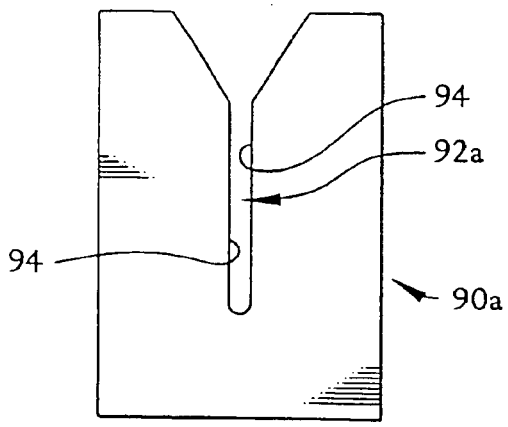
FIG. 5 PRIOR ART
FIGS. 5–8 are representative illustrations of prior art IDC configurations.
Figure 6:
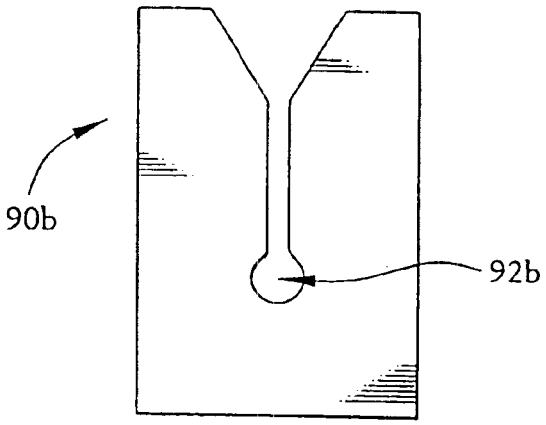
FIG. 6 PRIOR ART
Figure 7:
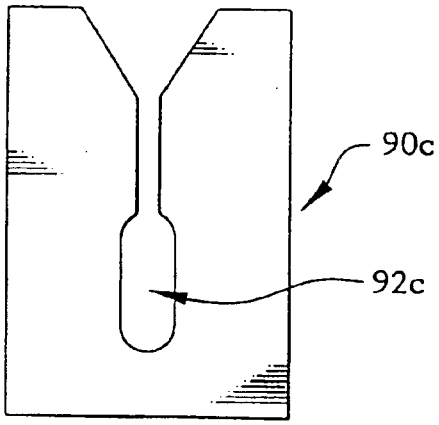
FIG. 7 PRIOR ART
Figure 8:
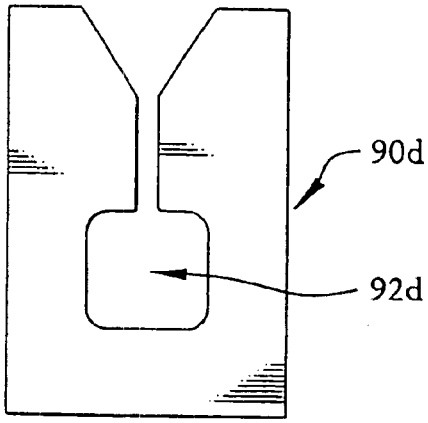
FIG. 8 PRIOR ART
Figure 9:
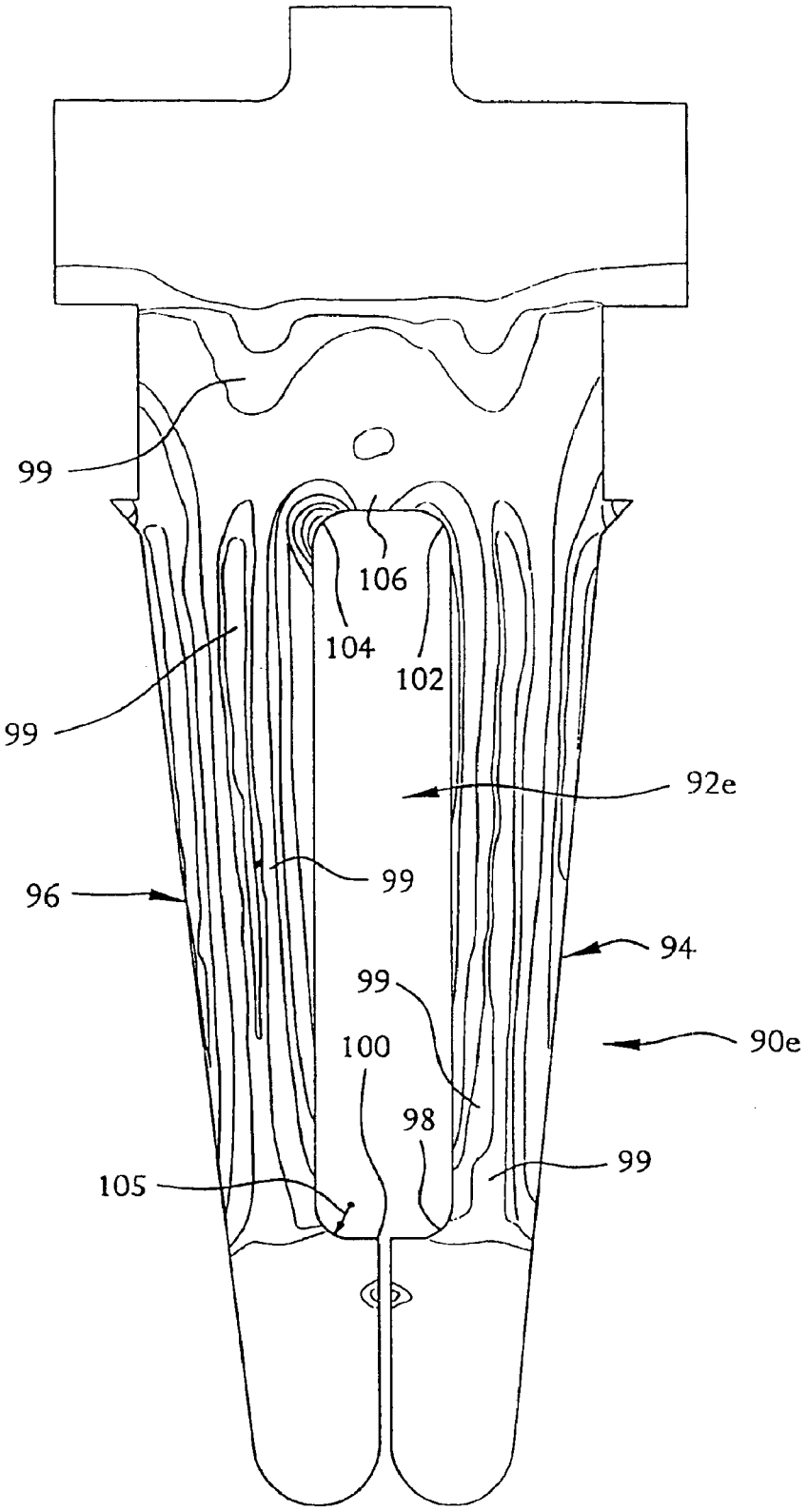
FIG. 9 is a finite element analysis stress distribution contour diagram of a prior art IDC connector.

FIGS. 5–8 are provided to show common shapes of apertures used in association with prior art IDC connectors. Specifically, FIG. 5 depicts an IDC 90*a* with an elongate aperture 92*a* formed by long, parallel walls 94, FIG. 6 depicts an IDC 90*b* with a circular aperture 92*b*, FIG. 7 depicts an IDC 90*c* with a generally oval aperture 92*c* and FIG. 8 depicts an IDC 90*d* with a square aperture 92*d*. FIG. 9 depicts yet another prior art IDC structure 90*e* having an elongated generally rectangular aperture 92*e*. These common forms encounter all of the problems noted hereinabove as the corresponding apertures have not been optimized for wire termination.

Figure 10:
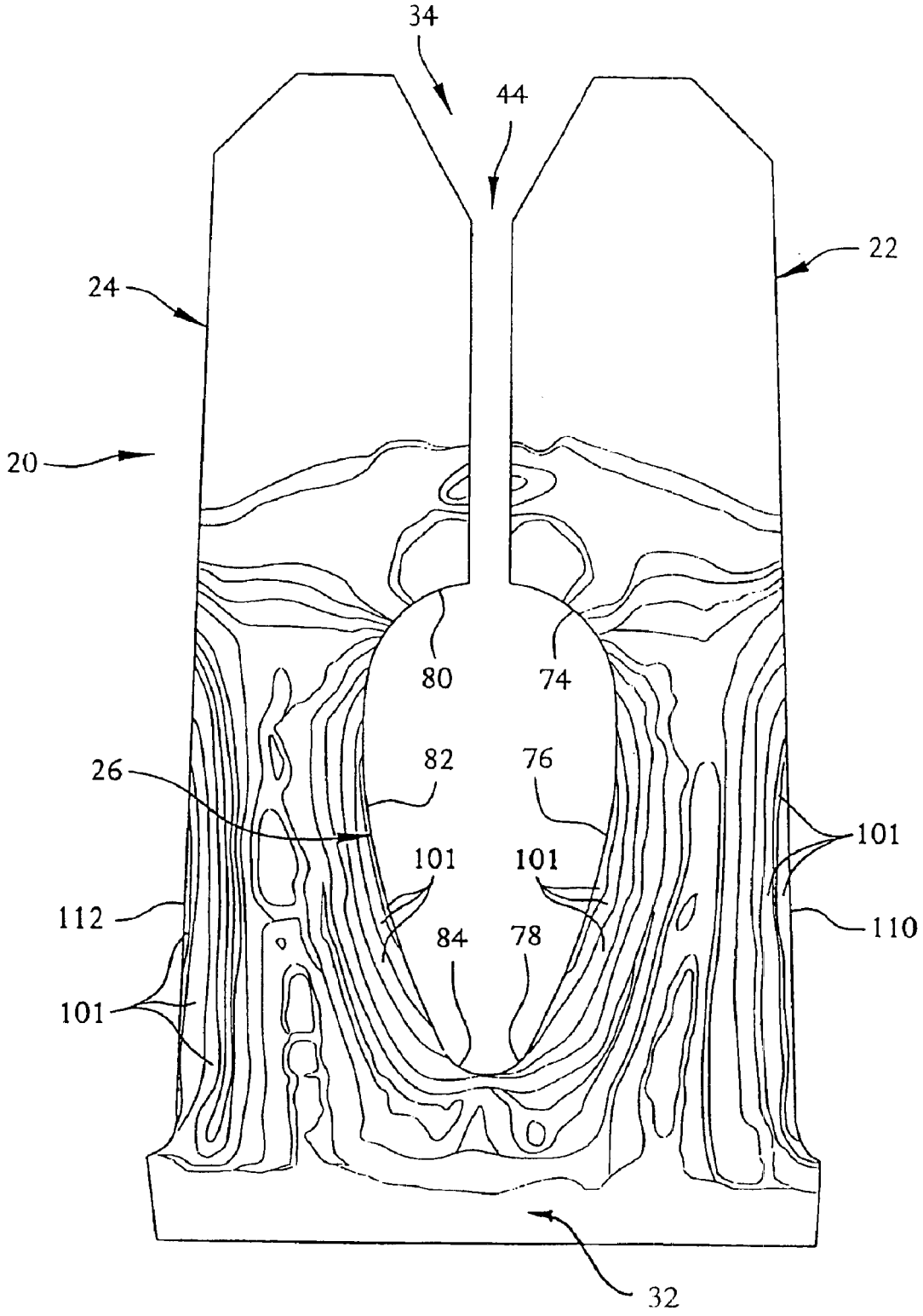
FIG. 10 is a finite element analysis stress distribution contour diagram of the IDC of the present invention.

FIGS. 9 and 10 are finite element analysis stress distribution contours which show comparative stress distribution for prior art IDC structure 90*e* and the IDC structure 20 of the present invention, respectively. As shown in FIG. 9, prior art IDC 90*e* is constructed with two beams 94, 96 which define the elongated generally rectangular aperture 92*e* therebetween. Corners 98, 100, 102, 104 of the aperture 92*e* have small radii 105. As a result, the stress distribution calculations indicate that areas of high stress are concentrated in the lower corners 102, 104 of the aperture 92*e*, as well as at a termination point 106 in the aperture 92*e*. Throughout the other areas of the beams 94, 96, such as at the areas which are identified by the reference numeral 99, the stress levels are generally very low.

In contrast, with reference to FIG. 10, the stress distribution in the IDC structure 20 is distributed over broad areas of the arcuate portions 74, 76, 78, 80, 82, and 84 defining the aperture 26. Preferably, higher levels of stress are concentrated in areas such as those areas which are identified by the reference numeral 101 and along the arcuate portions 76 and 82 defined by the mid-radius 70 (see FIG. 4) which also has the greatest radial dimension. As such, the stress is distributed over a broader area, thereby minimizing stress concentration in any given area of the IDC structure 20. Additionally, stress is also distributed along outer edges 110, 112, of the beams 22, 24, respectively. As such, the stress is distributed over wide areas of the beams 22, 24. Additionally, very little stress is applied in the material of the slot 44.

Another important consideration of the IDC structure 20 of the present invention is that while the insulation is cut, the material of the central conductor is not. Rather, the material of the conductor is deformed and displaced so as to provide greater contact surface area for making the conductive connection. Also, deformation and displacement of the conductor material prevents degrading the conductor strength. In contrast, the prior art tends to cut at least a portion of the conductor material and may not optimize the conductive connection between the IDC structure and the conductive wire.

While a preferred embodiment of the present invention is shown and described, it is envisioned that those skilled in the art may devise various modifications of the present invention without departing from the spirit and scope of the appended claims. For example, the aperture 26 and edge 62 defining same may vary from that which is depicted and described herein. Therefore, the invention is not intended to be limited by the foregoing disclosure.

What is claimed is:

1. A conductive terminal for receiving a conductor, said terminal comprising:

a base;

a pair of resilient beams extending from said base, said beams defining a mouth at an end thereof generally distal said base for receiving the conductor, said beams having facing inner edges defining a slot extending from said mouth, said beams defining a generally egg-shaped aperture in an area extending between said slot and said base.

2. The terminal as recited in claim 1, said egg-shaped aperture defining a generally continuous arcuate aperture edge.

3. The terminal as recited in claim 1, said egg-shaped aperture being defined by an aperture edge extending along both beams and joining said beams at said base, said aperture edge being defined by a plurality of radii.

4. The terminal as recited in claim 3, said aperture edge being defined by three pairs of different radii symmetrically arranged along each beam.

5. The terminal as recited in claim 1, said egg-shaped aperture being symmetrical about a central longitudinal axis of said terminal.

6. The terminal as recited in claim 5, said central longitudinal axis dividing said egg-shaped aperture into two halves, each half of said egg-shaped aperture being defined by an arcuate edge along a corresponding one of said pair of beams, said arcuate edge being defined by a plurality of radii, wherein said radii defining said arcuate edge of each half of said egg-shaped aperture are symmetrical about said central longitudinal axis with respect to the radii defining said arcuate edge of the other half of said egg-shaped aperture.

7. The terminal as recited in claim 6, each half of said egg-shaped aperture being defined by a generally continuous arcuate edge being defined by at least three radii.

8. The terminal as recited in claim 7, each half of said egg-shaped aperture being defined by three arcuate edge portions forming said generally continuous arcuate aperture edge.

9. The terminal as recited in claim 1, said egg-shaped aperture being divided into two halves positioned on either side of said slot, each half of said egg-shaped aperture being defined by a first edge portion, a second edge portion and a third edge portion, said first edge portion positioned adjacent said slot and being defined by a first radius, said second edge portion positioned adjacent said first edge portion and being defined by a second radius, and said third edge portion positioned adjacent said second edge portion and being defined by a third radius.

10. The terminal as recited in claim 9, wherein said third radius is smaller than said first radius, and said first radius is smaller than said second radius.

11. The terminal as recited in claim 9, wherein said first edge portions of each half of said egg-shaped aperture oppose each other, said second edge portions of each half of said egg-shaped aperture oppose each other, and said third edge portions of each half of said egg-shaped aperture oppose each other.

12. The terminal as recited in claim 1, further comprising a plurality of said pairs of resilient beams extending from said base.

13. A terminal for receiving a conductor, said terminal comprising:

a base; and two substantially parallel resilient cantilever beams extending from said base, said beams forming a mouth at an end thereof for receiving the conductor between said beams, a slot between said beam members extending from said mouth to an aperture, said aperture being non-symmetrical about an axis thereof, an upper portion thereof having a larger dimension that a lower portion thereof, said axis being perpendicular to a longitudinal axis of said terminal.

14. A terminal for receiving a conductor, said terminal comprising:

a base; and two substantially parallel resilient cantilever beams extending from said base, said beams forming a mouth at an end thereof for receiving the conductor between said beams, a slot between said beams extending from said mouth to an aperture, said aperture being non-circular and being defined by a generally continuous arcuate aperture edge.

15. A terminal for receiving a conductor, said terminal comprising:

a body, said body defining a mouth for receiving said conductor and a non-circular aperture communicating with said mouth, said non-circular aperture being defined by a generally continuous arcuate aperture edge comprising at least three arcuate edge portions, each of said three arcuate edge portions being defined by a corresponding radius.

16. A terminal for receiving a conductor, said terminal comprising:

a body, said body defining an aperture, a mouth of said body communicating with said aperture, said aperture being non-circular and defined by an edge spaced at said mouth and connected distal said mouth, said edge being defined by a plurality of different radii.

17. A terminal for receiving a conductor, said terminal comprising:

a body, said body defining an aperture, a mouth of said body communicating with said aperture, said aperture being non-circular and defined by two symmetrical edges which are spaced at said mouth and connected distal said mouth, each of said edges being defined by three different radii.

18. The terminal recited in claim 17, wherein said three different radii include a top radius, a middle radius and a bottom radius, said aperture being defined by the following radii ratios, 0.05<top radius/middle radius<0.28, and 1.3<top radius/bottom radius<4.3, and 0.1<top radius/height<0.35 in which the height is the dimension of the aperture measured from the upper most portion of the aperture to the lower most portion of the aperture.

19. An insulation displacement connector comprising:

first and second beams joined at a base and extending away therefrom, each of said beams having a top edge;

a slot formed between said beams extending away from the top edges of said beams toward said base, said slot being bordered by two oppositely disposed, generally parallel side edges, one of said side edges being a part of said first beam and the other of said side edges being a part of said second beam, said slot for receiving an electrical conductor and said beams for providing a force on said conductor normal thereto; and an aperture formed between said beams at the end of said slot, said slot opening into said aperture, said aperture extending from said slot to said base and being egg shaped with a larger end portion of said egg shaped aperture being nearest said slot and a smaller end portion of said egg-shaped aperture being nearest said base, said aperture being bordered by two curved edges, one of said curved edges being a portion of said first beam and the other of said curved edges being a portion of said second beam, each of said curved edges having a smooth transition through a plurality of radii and being joined together at said base at a location furthest from said top edges of said beams.

20. The apparatus as claimed in claim 19 wherein:

said conductor causes stress in said beams, said stress being greatest in said beams at a location about midway along said aperture as it extends away from said slot and at a location along outer edges of said beams.

21. The apparatus as claimed in claim 20 wherein:

said stress being greatest where said plurality of radii have their largest dimensions.

22. The apparatus as claimed in claim 19 wherein:

said plurality of radii include larger and smaller dimensions, and the curved edges have radii with the larger dimensions disposed between the larger end portion and the smaller end portion of said egg shaped aperture.

23. The apparatus as claimed in claim 22 wherein:

said conductor causes stress in said beams, said stress being greatest in said beams at a location about mid-way along said aperture as it extends away from said slot and at locations along outer edges of said beams.

24. The apparatus as claimed in claim 23 wherein:

said stress being greatest where said curved edges have radii with their largest dimensions.

25. An insulation displacement connector comprising:

first and second upstanding beams of conductive metal;

said first and said second beams being separated by an electrical conductor receiving slot extending for a first vertical distance away from upper ends of said first and said second beams;

said first and said second beams also being separated by an aperture, said aperture opening from said slot and extending for a second vertical distance away from said upper ends of said first and said second beams, and said aperture having top, middle and bottom portions and horizontally extending width dimensions therein; and said aperture having its largest horizontal width dimension in said top portion, a smaller horizontal width dimension in said middle portion relative to said horizontal width dimension of said top portion and a smallest horizontal width dimension in said bottom portion relative to said horizontal width dimensions of said top and said middle portions.

26. The apparatus as claimed in claim 25 wherein:

said aperture is shaped to have a continuing reduction in the horizontal width dimensions in said vertical direction away from said upper ends of said first and said second beams and below said top portion.

27. The apparatus as claimed in claim 26 wherein:

said slot is adapted to receive an insulated conductor, said conductor causing stress in said first and said second beams, said stress being at its maximum adjacent said middle portion of said aperture.

28. The apparatus as claimed in claim 27 wherein:

said first and said second beams having inner and outer edges thereof, said maximum stress being located along said inner and said outer edges.

29. The apparatus as claimed in claim 28 wherein:

said aperture is formed by a plurality of radii, where radii in said middle portion are larger than radii in said top and bottom portions.

30. The apparatus as claimed in claim 29 wherein:

said first and said second vertical distances are about equal.

31. An insulation displacement connector comprising:

an electrically conductive metal strip divided into two generally parallel beams, each beam having inner and outer edges;

a slot formed between said beams along said inner edges, said slot extending from a top end of said strip for a first predetermined distance; and an aperture in communication with said slot and extending away from said slot for a second predetermined distance, said aperture opening to its largest width dimension near said slot and then smoothly tapering to smaller width dimensions in a direction away from said slot.

32. The apparatus as claimed in claim 31 wherein:

said aperture has an egg shape in an elevational view.

33. The apparatus as claimed in claim 31 wherein:

said slot is adapted to receive an insulated conductor where said conductor causes stress in said beams, said stress being greatest in said beams near said aperture about mid-way along said second predetermined distance and near said outer edges thereof.

34. The apparatus as claimed in claim 33 wherein:

said stress near said outer edges being located at about the same vertical distance from said slot as said stress near said aperture.

35. The apparatus as claimed in claim 31 wherein:

said aperture is comprised of a varying radii curve symmetrical about a central vertical axis where larger radii occur at a middle portion of said aperture along said second predetermined distance; and said slot is adapted to receive an insulated conductor where said conductor causes stress in said beams, said stress being greatest in said beams near said middle portion of said aperture and near said outer edges thereof.

36. The apparatus as claimed in claim 35 wherein:

said stress also being greatest near said outer edges located about equal the vertical distance from said slot as is said middle portion of said aperture.

37. An insulation displacement connector comprising:

a first beam having a length;

a second beam having a length;

a base connecting said first and said second beams;

a slot formed between said first and said second beams extending for a portion of said lengths of said first and said second beams; and an egg shaped aperture formed between said first and said second beams extending from an end of said slot for another portion of said lengths of said first and said second beams wherein stress created by an electrical conductor being received by said slot is distributed in said first and said second beams so as to allow the connector to be reduced in size without a reduction in function.

38. The apparatus as claimed in claim 37 wherein:

said stress is concentrated in said beams along the portions of the aperture having larger middle radii.

39. The apparatus as claimed in claim 37 wherein:

said stress is minimized in said base where said beams are connected.

40. The apparatus as claimed in claim 37 wherein:

said connector is reduced in size by about fifty percent.

41. The apparatus as claimed in claim 37 wherein:

said connector accommodates a plurality of wire sizes in said slot.

42. The apparatus as claimed in claim 37 wherein:

said stress is distributed to allow said connector to be reduced in size and increased in strength.

43. The apparatus as claimed in claim 42 wherein:

said connector is reduced in size by about fifty percent.

44. The apparatus as claimed in claim 42 wherein:

a plurality of said reduced sized connectors have a high density when packaged for use.

45. An insulation displacement connector comprising:

an electrically conductive body having a first portion and a second portion, said body having a slot in said first portion and an egg-shaped aperture in said second portion.

46. The apparatus as claimed in claim 45 wherein:

said egg-shaped aperture having a larger end and a smaller end, said aperture being disposed with said larger end opening to said slot.

47. An insulation displacement connector comprising:

an electrically conductive body having a first portion and a second portion, said body having a slot in said first portion and an oviform shaped aperture in said second portion.

48. The apparatus as claimed in claim 47 wherein:

said oviform shaped aperture includes a broader end, said broader end being disposed adjacent said slot.

49. An insulation displacement connector comprising:

a thin metal strip formed to have two legs, a base and an opening between said legs and above said base, said opening including an upper elongated slot portion with parallel sides and a lower egg shaped portion.

50. An insulation displacement connector comprising:

a thin metal strip formed to have two legs, a base and an opening between said legs and above said base, said opening having an enlarged lower portion and an elongated slot upper portion, said opening lower portion including a lower rounded part, a curved diverging part above said lower rounded part and a curved converging part above said curved diverging part and beneath said elongated slot upper portion, said curved diverging part and said curved converging part formed of changing radii.

51. An insulation displacement connector comprising:

a thin metal strip formed to have two legs, a base and an opening between said legs and above said base, said opening having an enlarged lower portion and an elongated slot upper portion, said lower portion of said opening having a lower part surrounded by curved walls having smaller radii, a middle part surrounded by walls having larger radii and a top part surrounded by walls having radii larger than said walls with smaller radii and smaller than said walls with larger radii.

* * * * *